US010385487B2

(12) United States Patent
Jeon

(10) Patent No.: US 10,385,487 B2
(45) Date of Patent: Aug. 20, 2019

(54) ELECTRICALLY CONDUCTIVE FABRIC AND MANUFACTURING METHOD AND APPARATUS THEREOF

(71) Applicant: Byung-Ok Jeon, Gimhae-si (KR)

(72) Inventor: Byung-Ok Jeon, Gimhae-si (KR)

( * ) Notice: Subject to any disclaimer, the term of this patent is extended or adjusted under 35 U.S.C. 154(b) by 278 days.

(21) Appl. No.: 15/586,688

(22) Filed: May 4, 2017

(65) Prior Publication Data

US 2017/0233903 A1 Aug. 17, 2017

Related U.S. Application Data

(63) Continuation-in-part of application No. 13/521,025, filed as application No. PCT/KR2011/000232 on Jan. 13, 2011, now abandoned.

(30) Foreign Application Priority Data

Jan. 14, 2010 (KR) ..... 10-2010-0004164

(51) Int. Cl.

| | |
|---|---|
| ***D04B 21/14*** | (2006.01) |
| ***D03D 13/00*** | (2006.01) |
| ***D03D 27/06*** | (2006.01) |
| ***D03D 15/00*** | (2006.01) |
| ***D02G 3/44*** | (2006.01) |

(52) U.S. Cl.

CPC ..... *D04B 21/14* (2013.01); *D02G 3/441* (2013.01); *D03D 13/004* (2013.01); *D03D 15/00* (2013.01); *D03D 27/06* (2013.01); *D10B 2401/16* (2013.01)

(58) Field of Classification Search

CPC ..... D04B 1/103; D04B 1/123; D04B 1/22; D04B 21/14; D04B 21/16; D04B 21/20; D04B 7/14; D04B 7/30; D04B 39/06

See application file for complete search history.

(56) References Cited

U.S. PATENT DOCUMENTS

| | | | |
|---|---|---|---|
| 1,736,590 | A | 11/1929 | Graham et al. |
| 6,341,504 | B1 | 1/2002 | Istook |
| 2004/0079432 | A1 | 4/2004 | Kobayashi et al. |
| 2006/0124193 | A1 | 6/2006 | Orr et al. |

FOREIGN PATENT DOCUMENTS

| | | |
|---|---|---|
| CN | 101346499 | 1/2009 |
| DE | 203 20 479 | 12/2004 |
| DE | 103 42 285 | 2/2005 |
| DE | 10 2006 036 405 | 8/2007 |
| EP | 0 610 490 | 8/1994 |
| WO | 01/18296 | 3/2001 |
| WO | 2007/071077 | 6/2007 |
| WO | 2008/129118 | 10/2008 |
| WO | 2009/145536 | 12/2009 |

*Primary Examiner* — Jenna L Johnson

(74) *Attorney, Agent, or Firm* — Novick, Kim & Lee; Jae Youn Kim

(57) ABSTRACT

The present invention discloses to relates to an electrically conductive fabric, and a manufacturing method and an apparatus thereof, and more specifically to an electrically conductive fabric, and a manufacturing method and an apparatus thereof, wherein part of electrically conductive wire knitted or woven together into fabric is selectively exposed to the outside of the fabric to perform the tying of electrically conductive wires and the connection of various elements and modules quickly and conveniently, so that workability and productivity can be improved.

6 Claims, 14 Drawing Sheets

ELECTRICALLY CONDUCTIVE FABRIC AND MANUFACTURING METHOD AND APPARATUS THEREOF

CROSS REFERENCE TO RELATED APPLICATIONS

This application is a continuation-in-part application of U.S. patent application Ser. No. 13/521,025, filed Jul. 6, 2012 (now pending), the disclosure of which is herein incorporated by reference in its entirety. The U.S. patent application Ser. No. 13/521,025 is a national entry of International Application No. PCT/KR2011/000232, filed on Jan. 13, 2011, which claims priority to Korean Application No. 10-2010-0004164 filed on Jan. 14, 2010, the entire contents of which are incorporated herein by reference.

TECHNICAL FIELD

The present invention relates to an electrically conductive fabric, and a manufacturing method and an apparatus thereof, and more specifically to an electrically conductive fabric, and a manufacturing method and an apparatus thereof, wherein part of electrically conductive wire woven or knitted together into fabric is selectively exposed to the outside of the fabric to perform the tying of electrically conductive wires and the connection of various elements and modules quickly and conveniently, so that workability and productivity can be improved.

BACKGROUND ART

In general, fabrics such as knitted fabrics or woven fabrics (below to be described commonly as fabrics) that are used to manufacture bed covers, curtains, clothes, etc. are woven by natural fiber yarn or man-made fiber yarn, and their kinds are various, and they have properties and characteristics unique in their own way according to the purpose of use, such as heat conservation, absorptivity, stretchability, etc.

And as industrial society becomes more sophisticated and uses more high technology, modern people demand fabrics having new functions in addition, conventionally, to heat conservation for keeping away coldness, stretachability for ensuring sufficient freedom of motion and absorptivity for absorbing sweat.

For instance, fabrics in demand are those that can conduct electric current for various electric appliances to be installed for convenient use or those that perform heating action or cooling action by themselves. For such fabrics can realize beds, intelligent clothes, etc. which are light and thin and can be used regardless of season.

Accordingly, in the textile industry various efforts and research and development are being made to meet such social demand and lead a future textile industry. As a representative result of research, a planar heating unit made by weaving carbon fiber yarn has been developed.

Such a planar heating unit woven by carbon fiber yarn performs heating action when power is supplied, so it can be applied to the goods that need warming action, but it has a disadvantage that it cannot be applied to bed material that needs a cushioning function or clothes that need stretchability and freedom of motion because it does not have stretchability at all due to the characteristics of carbon fiber yarn. And if friction force is applied continuously while it is being used, the fine structures of carbon fiber yarn become loosened and damaged or minute electrical sparks are generated, so it was not possible to secure sufficient durability and safety.

In addition, smart clothes equipped with electronic appliances such as a wearable computer and an MP3 player need conductive wires for electrically connecting operating buttons, power supply unit, various electronic elements, etc. and for transmitting electric signals, but a planar heating unit manufactured with carbon fiber yarn has a limit that it cannot perform such functions at all. As a way for solving such problems, a method of stitching an extra conductive wire such as copper wire to clothes can be suggested, but because a copper wire does not have any stretchability at all, the freedom of motion and wearability as clothes are not good. Another disadvantage is that it is very inconvenient to use it because the conductive wire and control buttons installed in the clothes have to be removed to wash them.

Accordingly, as a scheme for solving the above mentioned conventional problems, the present applicant has filed Korean Patent Application No. 10-2008-0050545 (title of invention: Electrically conductive pad and manufacturing method thereof), Korean Patent Application No. 10-2008-0128928 (title of invention: Electrically conductive pad), and Korean Patent Application No. 10-2009-0043932 (title of invention: Electrically conductive pad and manufacturing method thereof).

According to these patents, it is possible to make fabrics having stretchability by a method of weaving conductive wires, so it is possible to make them perform heating action without sewing extra conductive wires or realize beds or clothes that can conduct electricity or perform the function of transmitting electric signals.

However, the electrically conductive fabrics that the present applicant earlier filed for a patent therefor has a disadvantage that it is cumbersome to do the work of tying the woven conductive wire together with the fabric yarn into a fabric to configure connection or a circuit with the power supply unit or the work of connecting various elements or modules. In other words, because the worker has to find one by one the electrically conductive wires contained in the fiber yarn configuring electrically conductive woven fabrics to connect each other, it has disadvantages that the work of finding the electrically conductive wires is hard and takes time so as to cause the deterioration of workability and productivity and the fiber yarns nearby are damaged in the course of finding the electrically conductive wires.

DISCLOSURE

Technical Problem

The present invention is directed to solve conventional problems described above and an object of the present invention is to provide an electrically conductive fabric with workability and productivity improved by quickly and conveniently carrying out the tying of electrically conductive wires and connection of various elements and modules by selectively exposing part of electrically conductive wires woven or knitted together with the fabrics to the outside of the fabrics, and a manufacturing method and an apparatus thereof.

Technical Solution

In order to accomplish the foregoing purposes of the present invention, there is provided an electrically conductive fabric comprising: multiple strands of wales arranged lengthwise; multiple strands of connecting threads connected with the wales; and at least one strand of electrically conductive wire arranged lengthwise, wherein the electrically conductive fabric includes a repeated pattern of: a knitted section in which the electrically conductive wire is bound by at least two of the strands of connecting threads; and an electrically conductive wire exposing section in which the electrically conductive wire is not bound by at least one of the strands of connecting threads but is exposed to the outside of the electrically conductive fabric by a predetermined length, and wherein the strands of connecting threads include: a first connecting thread which is connected with the strands of wales in a manner that the first connecting thread is disposed at one side of the electrically conductive wire; a second connecting thread which is connected with the strands of wales in an area where the electrically conductive wire is not arranged; and a third connecting thread which is connected with the strands of wales to selectively bind the electrically conductive wire, wherein the electrically conductive wire is bound by the third connecting thread and the first connecting thread in the knitted section such that the third connecting thread is disposed at another side of the electrically conductive wire which is opposite to the one side of the electrically conductive wire, and the electrically conductive wire is not bound by the third connecting thread in the electrically conductive wire exposing section.

In order to accomplish the foregoing purposes of the present invention, there is provided an electrically conductive fabric comprising: multiple strands of warps arranged lengthwise; multiple strands of wefts woven with the warps: and at least one strand of electrically conductive wire arranged lengthwise and woven in a planar shape, wherein an electrically conductive wire weaving section in which the electrically conductive wire is woven to the warp and/or weft to be bound monolithically to the electrically conductive fabric and an electrically conductive wire exposing section in which the electrically conductive wire is not woven to the warp and/or weft but is exposed to the outside of the electrically conductive fabric by a predetermined length are repetitively formed.

The electrically conductive fabric may further comprise a binding-and-releasing weft which is fed simultaneously at the time of weaving the electrically conductive wire, wherein the binding-and-releasing weft is woven with the warp and/or weft so that the electrically conductive wire is woven so as to be bound to the warp and/or weft in the electrically conductive wire weaving section, and is woven with the warp and/or weft so that the electrically conductive wire is woven so as not to be bound to the warp and/or weft in the electrically conductive wire exposing section.

Preferably, the weft includes a first warp-knitting weft which is knitted with the warp on the inside of the electrically conductive wire; a second warp-knitting weft which is knitted with the warp so as to provide a feeding free zone which is not knitted in the range of the width corresponding to the placement width of the electrically conductive wire on the outside of the electrically conductive wire; and a binding-and-releasing weft which is knitted with the warp so as to selectively bind the electrically conductive wire at the position corresponding to the feeding free zone, and the binding-and-releasing weft is knitted in such a way that the electrically conductive wire is bound together to the warp and the first warp-knitting weft in the electrically conductive wire weaving section, and is knitted in the range where the electrically conductive wire is not to be bound to the warp and the first warp-knitting weft in the electrically conductive wire exposing section.

In order to accomplish the foregoing purposes of the present invention, there is also provided an electrically conductive fabric manufacturing method comprising a warp feeding process for feeding multiple strands of warp lengthwise, a weft feeding process for feeding multiple strands of weft, and a fabric weaving process in which the weft is woven to the warp by a weaving machine, the method characterized by further comprising: an electrically conductive wire feeding process for feeding at least one strand of electrically conductive wire in the weft feeding direction, wherein the fabric weaving process includes an electrically conductive wire weaving process for weaving together the electrically conductive wire, and wherein the electrically conductive wire weaving process includes an electrically conductive wire weaving step for woven the electrically conductive wire with the warp, and an electrically conductive wire exposing step in which the electrically conductive wire is fed while the electrically conductive wire weaving step is under way but is made not to be woven with the warp so that the electrically conductive wire is exposed to the outside of the electrically conductive fabric by a predetermined length.

In order to accomplish the foregoing purposes of the present invention, there is also provided an electrically conductive fabric manufacturing apparatus comprising: a warp weaving unit for weaving lengthwise multiple strands of warp fed from a warp feeding unit; a weft weaving unit for weaving multiple strands of weft fed from a weft feeding unit; an electrically conductive wire weaving unit for weaving at least one strand of electrically conductive wire fed from an electrically conductive wire feeding unit; a warp guiding unit which pulls the warp on the side of the warp weaving unit to make possible the weaving action of the warp, weft and electrically conductive wire through interaction between the weft weaving unit and the electrically conductive wire weaving unit, and a weaving unit driving device which operates the warp weaving unit, the weft weaving unit, the electrically conductive wire weaving unit and the warp guiding unit to woven the weft in the direction perpendicular to the warp, and selectively weaves the electrically conductive wire with the warp.

In order to accomplish the foregoing purposes of the present invention, there is further provided an electrically conductive fabric manufacturing apparatus comprising: a warp weaving unit for weaving lengthwise multiple strands of warp fed from a warp feeding unit; a first weft weaving unit which is positioned on one side of the electrically conductive wire weaving unit to weave with the warp the multiple strands of the first warp-knitting weft fed from the weft feeding unit so as to form one side face of the electrically conductive fabric; a second weft weaving unit which is positioned on the other side of the electrically conductive wire weaving unit to weave with the warp the multiple strands of the second warp-knitting weft fed from the weft feeding unit so as to form the other side face of the electrically conductive fabric; a warp guiding unit which is positioned in opposition so as to pull the warp on the side of the warp weaving unit, and operates so that the warp, the first and second warp-knitting wefts and electrically conductive wire are knitted through interaction between the first and second weaving units and the electrically conductive wire weaving unit; and a weaving unit driving device which operates the warp weaving unit, the first and second weft weaving units, the electrically conductive wire weaving unit and the warp guiding unit so that the first and second warp-knitting wefts is knitted in the direction perpendicular to the warp and the electrically conductive wire is knitted selectively in the warp direction.

Advantageous Effects

According to the electrically conductive fabric and the manufacturing method and apparatus thereof of the present invention, there is provided an effect of being able to carry out tying or connecting work quickly and conveniently by forming electrically conductive wire exposing sections for the portions for tying electrically conductive wires or connecting various elements or modules, since they are provided with electrically conductive wire knitting sections where electrically conductive wires are knitted with yarns to be bound monolithically to an electrically conductive fabric and electrically conductive wire exposing sections where electrically conductive wires are not knitted with yarns to be exposed to the outside of the electrically conductive knitted fabrics by a predetermined length. Accordingly, it is possible to remarkably improve workability and productivity in the manufacture, maintenance and use of goods using electrically conductive fabrics.

BRIEF DESCRIPTION OF DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, preferred embodiments of the present invention will be described in detail in conjunction with accompanying drawings, especially, FIGS. 1A to 9. Referring to FIGS. 1A to 9, the same reference numbers are given for the same constitutional elements. Conventional technical configurations and functional effects thereof, which are easily conceived or understood by persons having ordinary skill in the related art, will be briefly described or omitted from detailed description. Instead, the foregoing inventive drawings may substantially illustrate subject matters relating to the present invention.

The present invention can be used in knitted fabrics and woven fabrics, and the woven fabrics will be described in a first embodiment of the present invention, the knitted fabrics will be described in a second embodiment of the present invention.

Figure 1A:
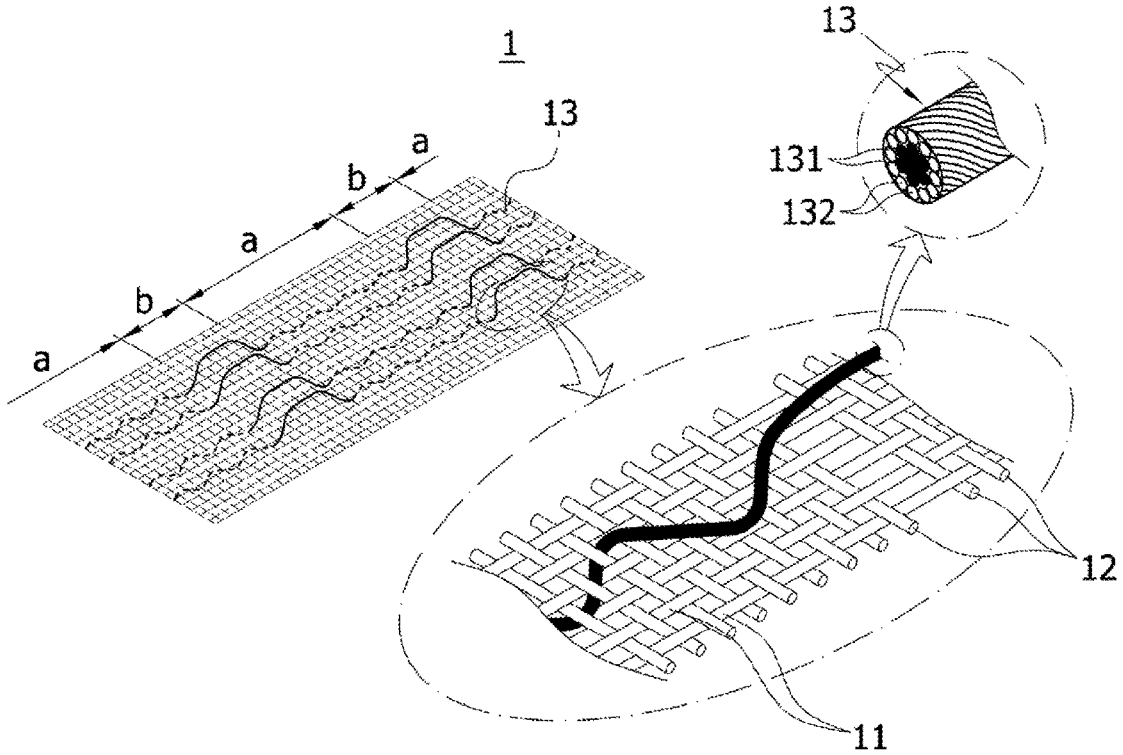
FIG. 1A is a view for describing an electrically conductive fabric according to a first embodiment of the present invention.
Figure 1B:
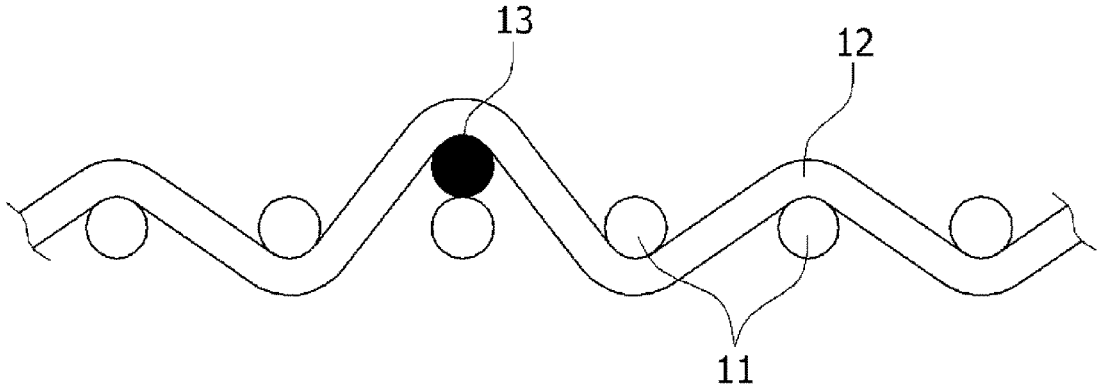
FIGS. 1B and 1C are sectional views schematically showing the structure for describing the electrically conductive fabric according to the first embodiment of the present invention.
Figure 1C:
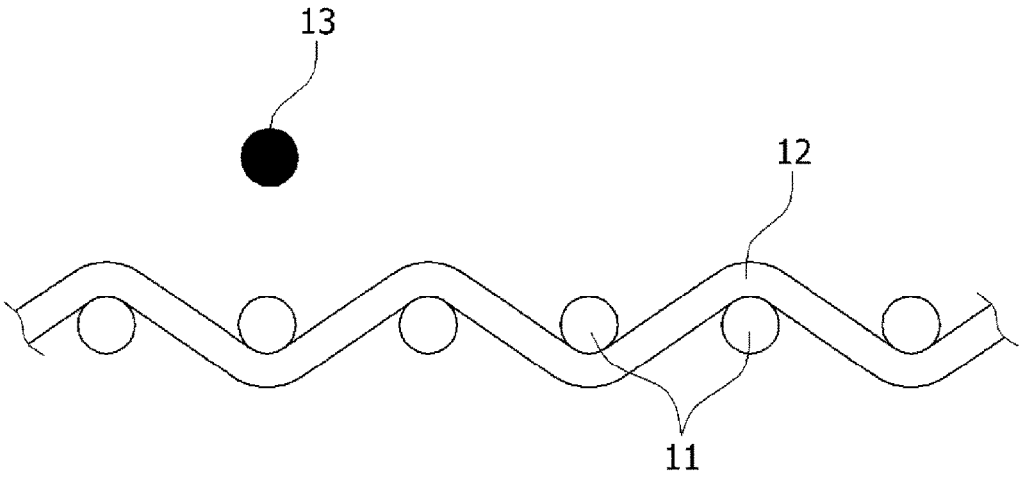

The attached FIG. 1A is a view for describing an electrically conductive woven fabric according to a first embodiment of the present invention, and FIG. 1B and FIG. 1C are sectional views schematically showing the structure for describing the electrically conductive fabric according to the first embodiment of the present invention, wherein FIG. 1B shows the cross section of the electrically conductive wire weaving section, and FIG. 1C shows the cross section of the electrically conductive wire exposing section. In the description below, the warp refers to linear yarn arranged lengthwise of the electrically conductive fabric and the weft refers to the linear yarn woven with the warp.

As shown in FIGS. 1A to 1C, the electrically conductive fabric 1 according to the present invention is a fabric selectively comprising electrically conductive wires for heating that are formed in planar cloth and performs a heating action when electric current is supplied, electrically conductive wires for conduction of electric current and electrically conductive wire for signal transmission for transmitting electric signals. This fabric includes the multiple strands of warp 11 arranged lengthwise, plural strands of weft 12 are woven in the direction perpendicular to the warp 11, and plural strands of electrically conductive wires 13 arranged lengthwise and woven.

Especially the electrically conductive fabric 1 according to the present invention is characterized by being repetitively composed of the electrically conductive wire weaving sections a in which the electrically conductive wire 13 is woven with the warp 11 and/or weft 12 to be monolithically bound to the electrically conductive fabric as shown in FIGS. 1A and 1B, and electrically conductive wire exposing sections b in which the electrically conductive wire 13 is not woven with the warp and/or weft but is exposed to the outside of the electrically conductive fabric by a predetermined length as shown in FIGS. 1A and 1C.

The warp 11 is composed by applying common fiber yarn for the case of composing the electrically conductive fabric 1 so as not to have stretchability lengthwise, and by applying stretchable fiber yarn such as span yarn for the case of composing the electrically conductive fabric 1 so as to have stretchability lengthwise.

The weft 12 is composed by applying common fiber yarn; in case high strength is needed, it is composed by applying high-tension fiber yarn such as Kevlar yarn and aramid yarn.

The electrically conductive wire 13, as shown in enlargement in FIG. 1A, is composed by applying the one that is wound and formed into one bundle to sheathe plural strands of insulated electrically conductive yarn 131 with plural strands of fiber yarn 132. At this time, the electrically conductive yarn 131 can embodied by selecting yarns having various materials and diameters if they can conduct electric current, but in the present embodiment, they were selected from metal yarns (commonly called enamel wires) in which insulated sheathed layers are formed on stainless wires, titanium wires, copper wires, etc. having diameters of tens to hundreds of micrometers (μm) and plural strands of fiber yarn 132 are wound on the outer circumference as an outer layer. And the number of strands of the electrically conductive yarn 131 composing the electrically conductive wire 13 can be varied according to the use, purpose, etc. of electrically conductive fabric, but in the present embodiment the electrically conductive yarn is composed by bundling 5 to 20 strands into one.

And the electrically conductive wire 13 is woven so as to be arranged in a straight form structure or wave form structure along the direction of the warp. At this time, in the case that the electrically conductive wire 13 is woven in a straight form structure, it is preferable to compose such that the electrically conductive wire has stretchability as shown in the second modification to be described later.

Figure 1D:
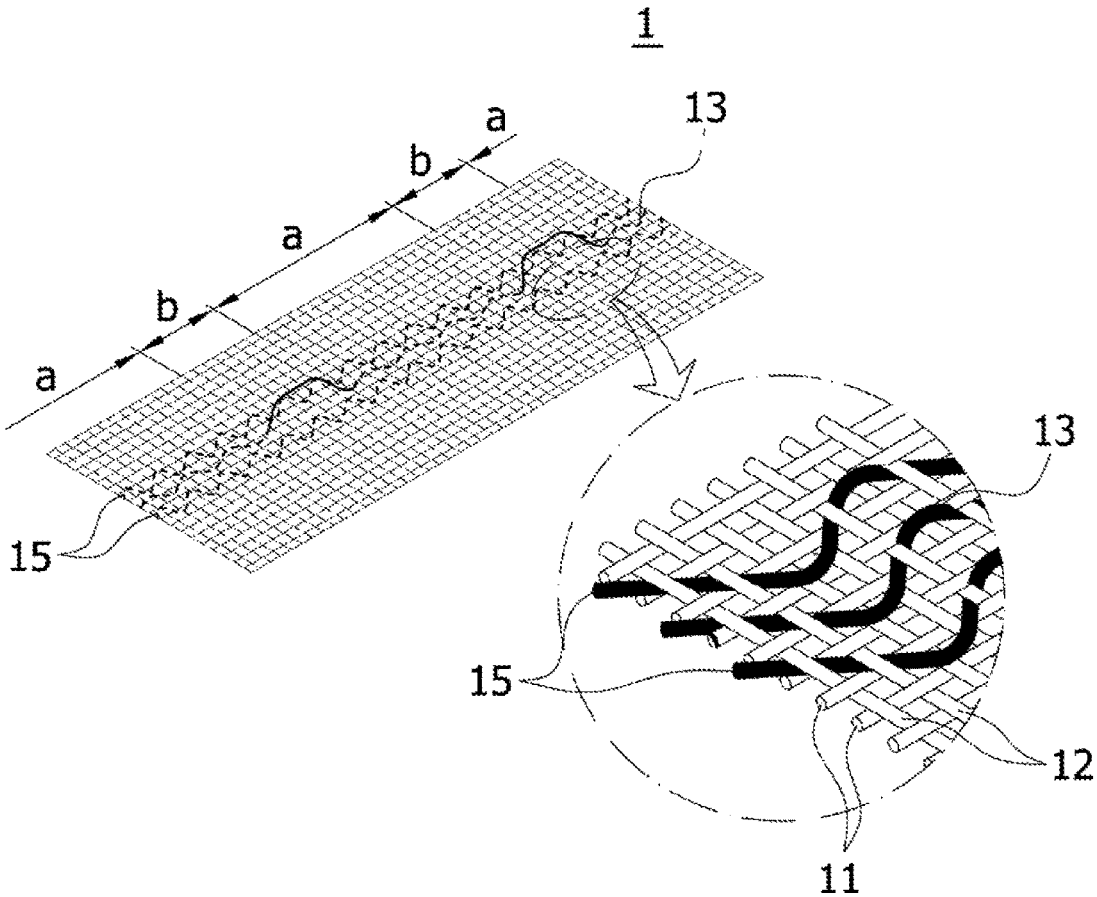
FIG. 1D is a view showing a first modification of the electrically conductive fabric according to the first embodiment of the present invention.

Next, FIG. 1D is a view showing the first modification of the electrically conductive fabric according to the first embodiment of the present invention; as shown in the drawing, the electrically conductive fabric includes support wires 15 which are woven along the placement path of the electrically conductive wire.

The support wires 15 are woven on the left and right of the electrically conductive wire 13 to bind it to the warp and weft so as to prevent deformation. Namely, if the electrically conductive wire 13 is composed of metal yarn, it is protruded to the surface or back of the electrically conductive fabric 1 due to the difference in flexibility from the fiber yarn supplied as the weft and warp. At this time, since the support wires 15 perform the function of holding the weft and warp on the left and right as reinforcement wires, the twist of the electrically conductive wire can be prevented. For this purpose, it is preferable that the support wire 15 has a plurality of fiber yarns twisted and a diameter (denier) greater than the weft and warp.

Figure 1E:
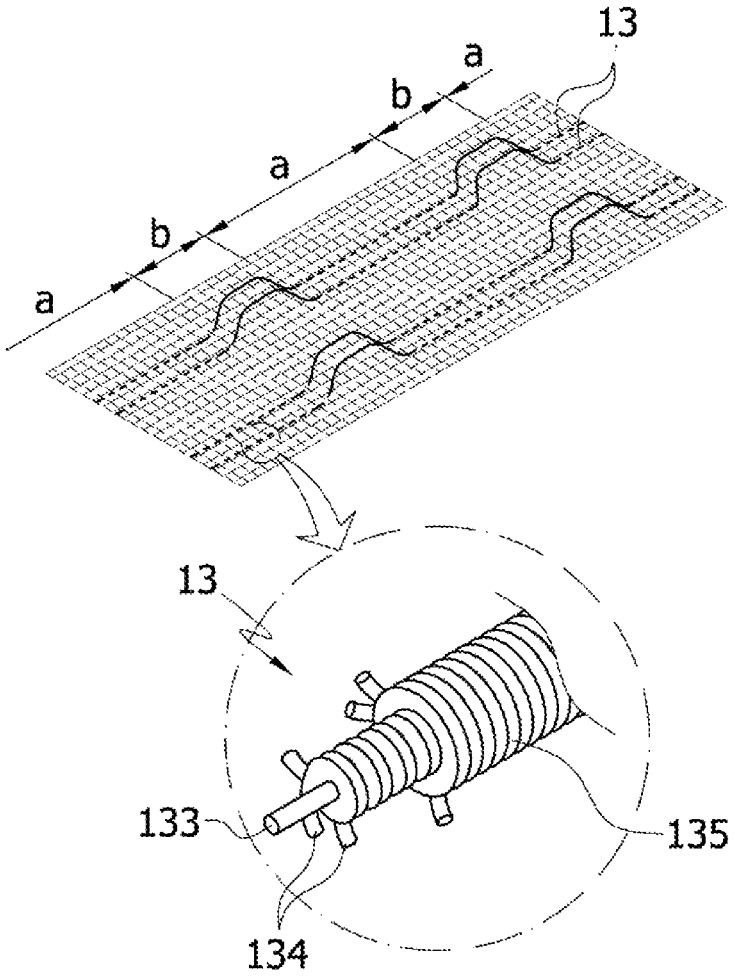
FIG. 1E is a view showing a second modification of the electrically conductive fabric according to the first embodiment of the present invention.

FIG. 1E is a view showing a second modification of the electrically conductive fabric according to the first embodiment of the present invention. The fabric illustrated in this embodiment is composed into a planar body having electrically conductive wire weaving sections a and electrically conductive wire exposing sections b by using the multiple strands of warp 11 arranged lengthwise, multiple strands of weft 12 are woven in the direction perpendicular to the warp, and plural strands of electrically conductive wires 13 arranged and woven lengthwise. At this time, the electrically conductive wire 13 is woven so as to be arranged in a straight form structure along the warp direction.

At this time, the electrically conductive wire 13, as shown in enlargement in FIG. 1E, includes a stretchable inner wire 133 disposed in the inner center and formed of material having stretchability like span yarn, plural strands of insulated electrically conductive yarn 134 wound on the inner wire 133, and outer layer 135 wound so as to have stretchability by winding plural strands of fiber yarn on the outer circumference of the electrically conductive yarn 134.

Figure 1F:
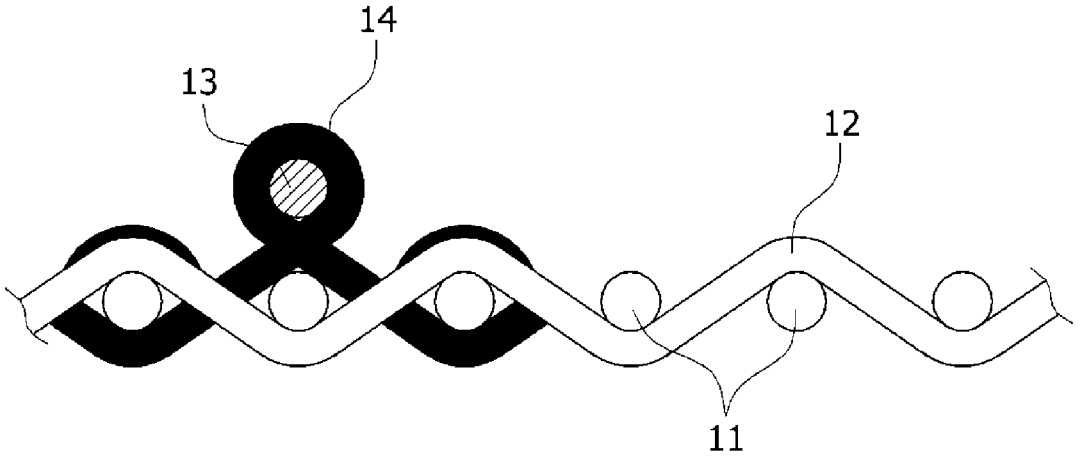
FIG. 1F is a view showing a third modification of the electrically conductive fabric according to the first embodiment of the present invention.

FIG. 1F is a view showing a third modification of the electrically conductive fabric according to the first embodiment of the present invention, wherein the cross section of the electrically conductive wire weaving section is illustrated, and the electrically conductive wire exposing section is omitted.

With reference to FIG. 1F, the electrically conductive fabric is composed in such a way that it has electrically conductive wire weaving sections a in which the electrically conductive wire is embedded in the planar body and electrically conductive wire exposing sections b in which the electrically conductive wire is exposed to the outside of the planar body, by making the electrically conductive wire 13 bound selectively to the warp 11 and/or weft 12 by an extra binding-and-releasing weft 14.

Namely, the binding-and-releasing weft 14 is supplied together when the electrically conductive wire 13 is woven to be woven to the warp and/or weft so that it is bound thereto in the electrically conductive wire weaving sections a, while the electrically conductive wire 13 is woven to the warp and/or weft so as not to be bound to the electrically conductive fabric 1 in the electrically conductive wire exposing section b.

Figure 2A:
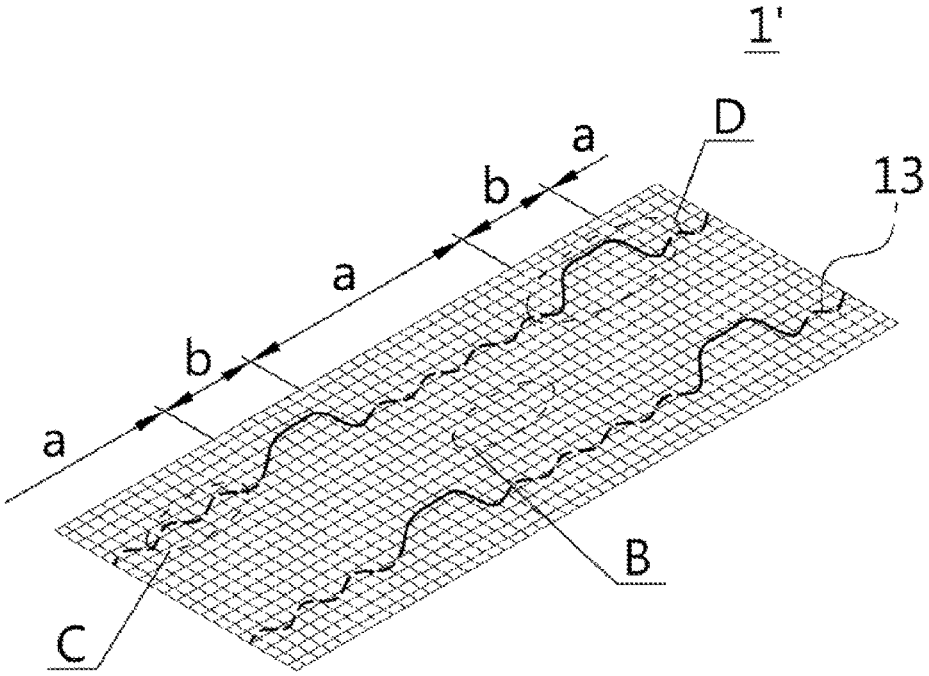
FIG. 2A is a view showing the appearance of the whole to describe an electrically conductive fabric according to a second embodiment of the present invention.
Figure 2B:
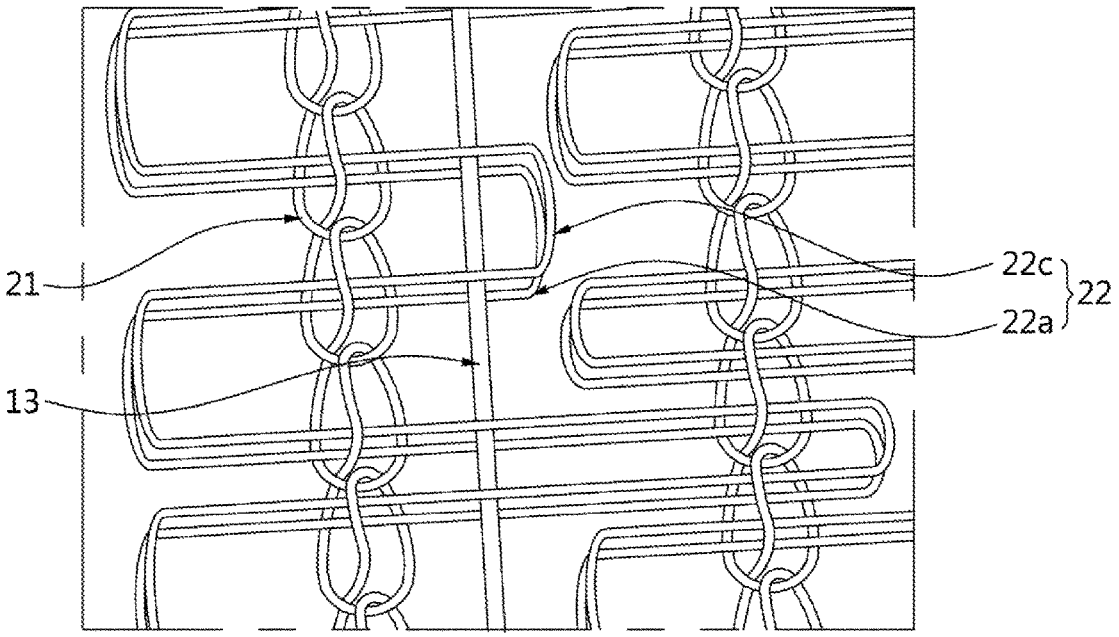
FIG. 2B to 2D are views showing the major part for describing the electrically conductive fabric according to the second embodiment of the present invention.
Figure 2C:
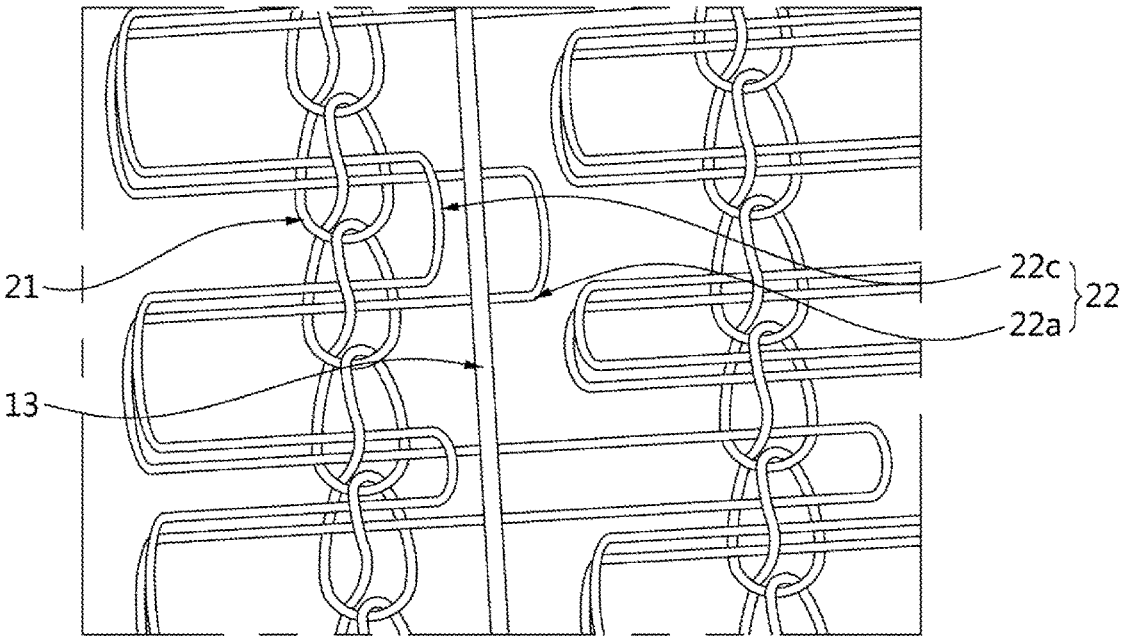
Figure 2D:
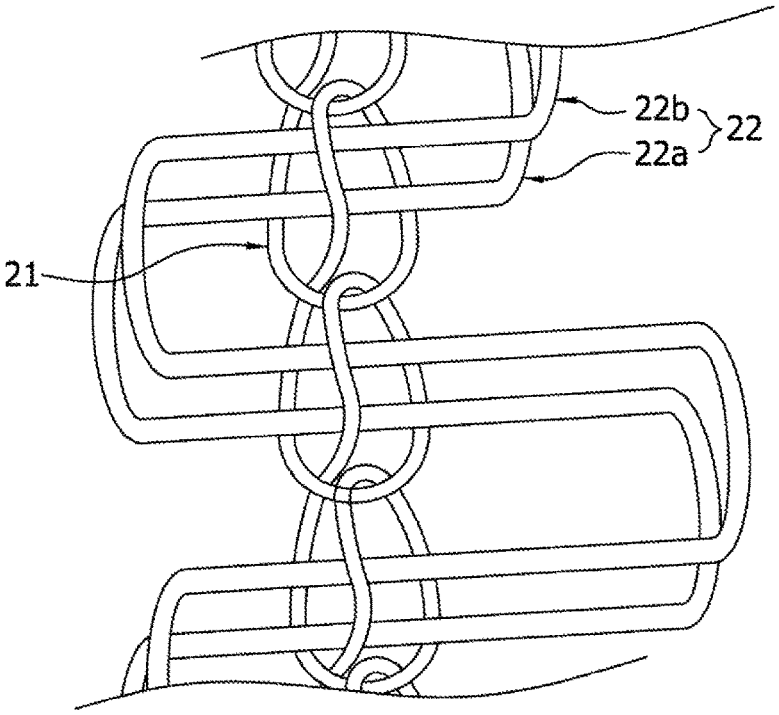

FIG. 2A is a view schematically showing the appearance of the whole for describing the electrically conductive fabric according to the second embodiment of the present invention, and FIGS. 2B to 2D are views showing the major part for describing the electrically conductive fabric according to the second embodiment of the present invention, wherein FIG. 2B is a view showing a part of part C of FIG. 2A, which is the electrically conductive wire knitting section; FIG. 2C is a view showing a part of part D of FIG. 2A, which is the electrically conductive wire exposing section; and FIG. 2D is a view showing part B of FIG. 2A, which is an area where the electrically conductive wire is not arranged. Duplicated explanation is omitted for compositions identical or similar to the first embodiment. Also, in the second embodiment of the present invention, although the electrically conductive wire can be knitted in such a way that it can be arranged in a straight form structure or wave form structure along the warp direction in the same manner as in the first embodiment mentioned above, only the one arranged in the wave form structure will be described. Also, although the conductive knitted fabrics according to the present invention can be warp knitted fabric or weft knitted fabric, only the warp knitted fabric will be described in the second embodiment of the present invention.

With reference to FIGS. 2A to 2C and FIG. 2D, the electrically conductive fabric 1' according to the second embodiment of the present invention includes multiple strands of wale 21 arranged lengthwise, multiple strands of connecting thread 22 connected in the direction perpendicular to the wale 21, and plural strands of electrically conductive wires 13 arranged lengthwise and knitted. With reference to FIG. 2A, wales are repetitively chain-stitched to provide a plurality of adjacent but independently looped threads, and the connecting thread 22 are connected to the wales to interconnect the wales with respect to each other.

The connecting thread 22 includes a first connecting thread 22*a* that is connected with the wale 21 at the position corresponding to the inside of the electrically conductive wire 13, a second connecting thread 22*b* (see FIG. 2D) that is connected with the wale 21 so as to provide a feeding free zone in the range of width corresponding to the placement width of the electrically conductive wire 13 at the position corresponding to the outside of the electrically conductive wire 13, and a third connecting thread 22*c* (see FIGS. 2B and 2C) that is connected with the wale 21 so as to selectively bind the electrically conductive wire 13 at the position corresponding to the feeding free zone.

The third connecting thread 22*c* is composed by being knitted such that the electrically conductive wire is bound together with the wale 21 and the first connecting thread 22*a*, in the electrically conductive wire knitting section a (see FIGS. 2A and 2B), and by being knitted within the range where the electrically conductive wire 13 is not bound with the wale 21 and the first connecting thread 22*a*, in the electrically conductive wire exposing section b (see FIGS. 2A and 2C).

And the electrically conductive wire 13 is knitted so as to make a waveform structure, and on both sides of the placement path of the electrically conductive wire 13, it is possible to compose in such a way that the support yarn 15 is knitted to support the electrically conductive wire, in a way similar to the first embodiment.

Figure 3:
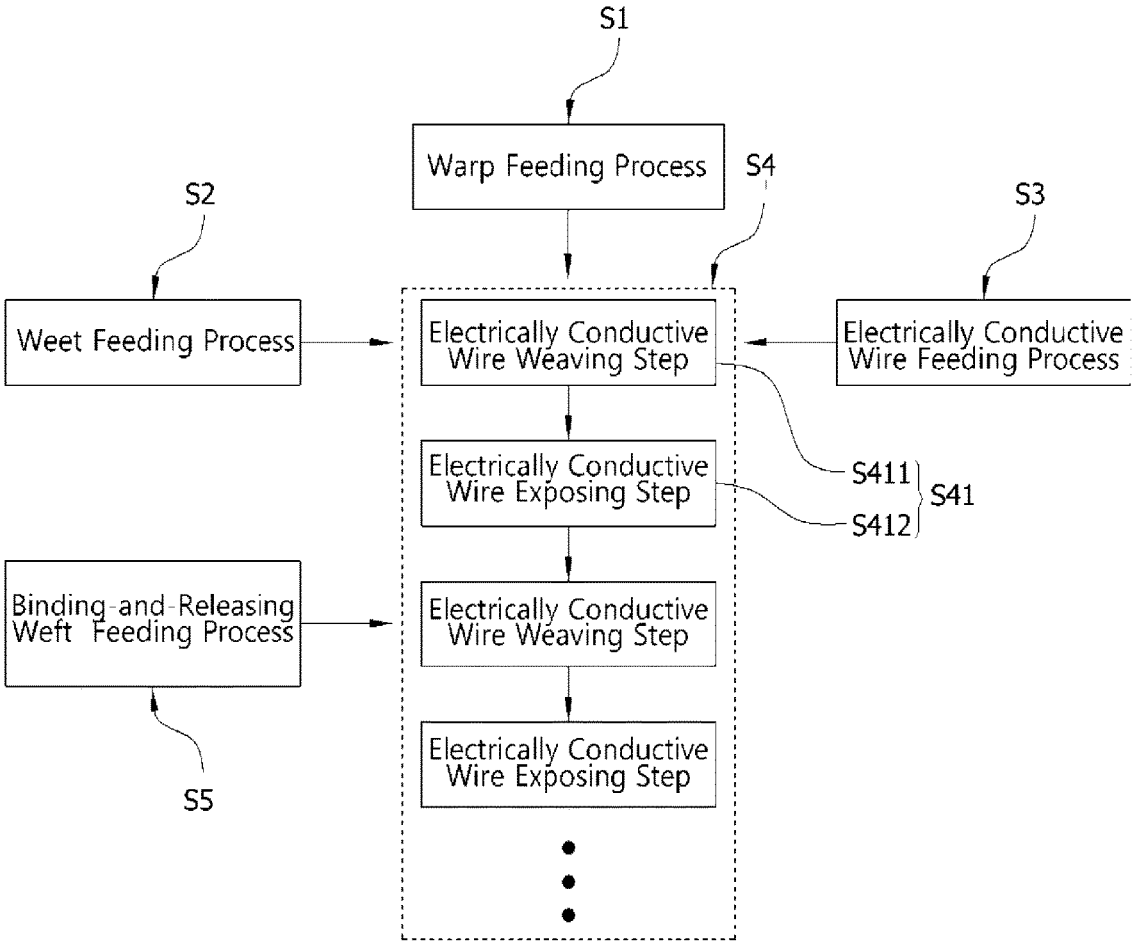
FIG. 3 is a block diagram of the process for describing the manufacturing method of the electrically conductive fabric according to the first embodiment of the present invention.

FIG. 3 is a block diagram of the process for describing the manufacturing method of the electrically conductive fabric according to the first embodiment of the present invention.

With reference to FIG. 3, the manufacturing method of the electrically conductive fabric according to the first embodiment of the present invention relates to the method of manufacturing an electrically conductive fabric of a shape illustrated in FIG. 1A by weaving machine. This manufacturing method comprises a warp feeding process (S1) for feeding multiple strands of warp lengthwise, a weft feeding process (S2) for feeding multiple strands of weft, an electrically conductive wire feeding process (S3) for feeding the electrically conductive wire in the weft feeding direction, and a fabric weaving process (S4) for weaving the weft in the direction perpendicular to the warp. The fabric weaving process (S4) further comprises an electrically conductive wire weaving process (S41) for weaving the electrically conductive wire 13 as well.

In the process for weaving the warp 11 and weft 12 with each other, the electrically conductive wire weaving process (S4) is characterized by including an electrically conductive wire weaving step (S411) in which the electrically conductive wire 13 is woven with the warp 11 and/or weft 12, and an electrically conductive wire exposing step (S412) in which the electrically conductive wire 13 is fed while the electrically conductive wire weaving step (S411) is under way but the electrically conductive wire 13 is made not to be woven with the warp 11 and/or weft 12 so that it is exposed to the outside of the electrically conductive fabric by a predetermined length.

In the warp feeding process (S1) and the weft feeding process (S2), the warp and weft, which are fiber yarns, are wound and prepared on the reel respectively in the same manner as the ordinary weaving process of fabrics, and the warp is fed to the warp weaving unit of the weaving machine, and the weft is fed to the weft weaving unit of the weaving machine.

In the electrically conductive wire weaving step (S411) to weave an electrically conductive fabric of the shape as shown in FIG. 1A, the weft 12 is woven with the warp 11 in such a way that the electrically conductive wire 13 is woven and bound to both of the warp 11 and the weft 12.

And in the electrically conductive wire exposing step (S412), the weft 12 is woven with the warp 11 in such a way that the weft 12 is not woven with the electrically conductive wire 13.

Meanwhile, in the case of weaving an electrically conductive fabric of the shape as illustrated in FIG. 1F, the electrically conductive wire 13 is not bound by the weft 12, but the electrically conductive wire 13 is woven and bound to the warp 11 and/or the weft 12. For this purpose, a separate binding-and-releasing weft feeding process (S5) is implemented for feeding the binding-and-releasing weft 14, so that an electrically conductive wire weaving process (S41) becomes possible.

In the electrically conductive wire weaving step (S411), the electrically conductive wire 13 is woven and bound to the electrically conductive fabric through the process for weaving the binding-and-releasing weft 14 with the warp 11 and/or weft 12. And the electrically conductive wire weaving step (S411) weaves in such a way that the electrically conductive wire 13 is arranged in a straight form structure of a waveform structure along the direction of the warp.

In addition, the electrically conductive exposing step (S412) carries out the process for weaving and binding the binding-and-releasing weft 14 to the warp 11, in such a way that the binding-and-releasing weft 14 is not woven with the electrically conductive wire 13.

The electrically conductive fabric manufacturing method according to the first embodiment of the present invention can be carried out by the electrically conductive fabric manufacturing apparatus to be described in detail below.

Figure 4A:
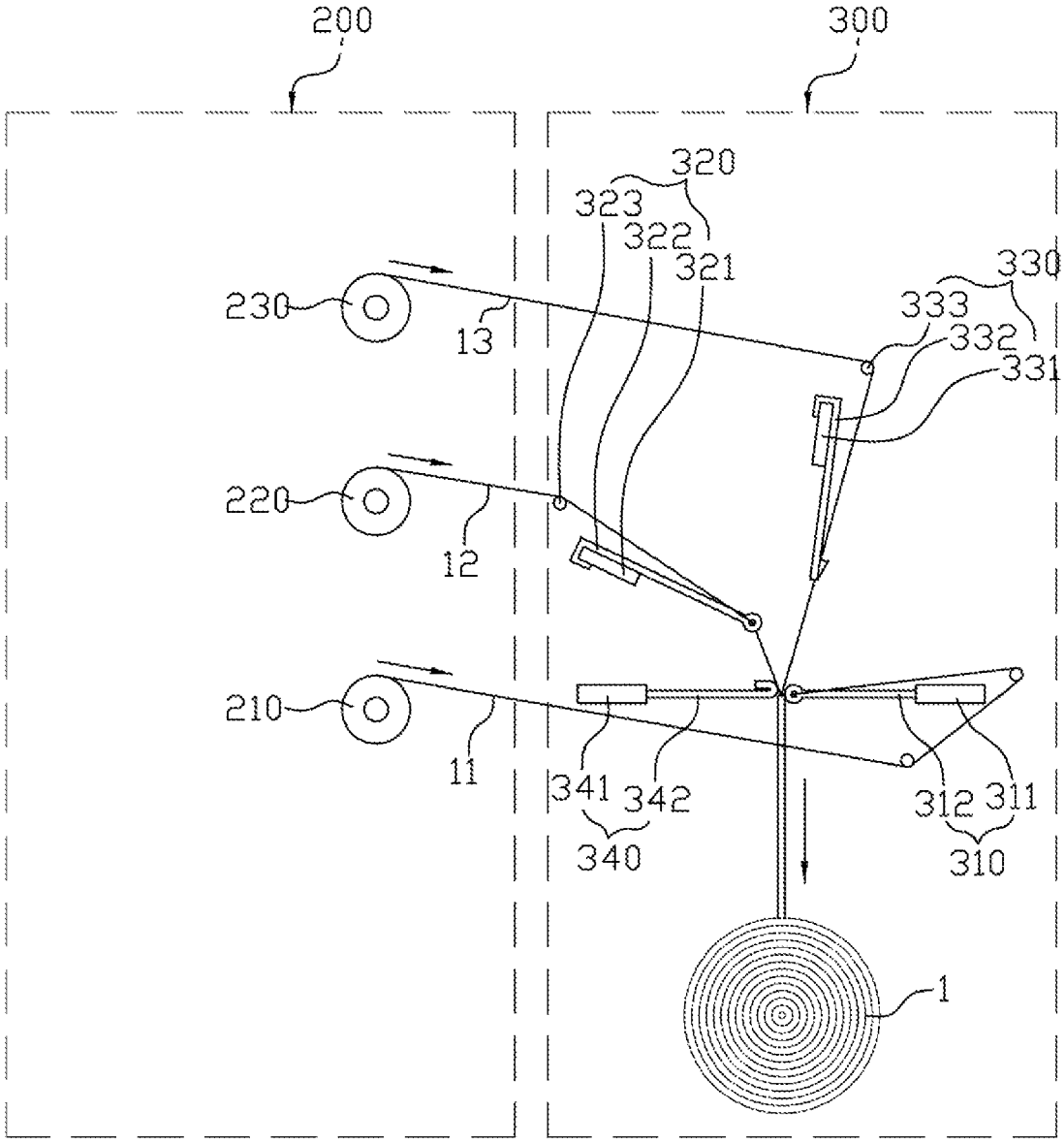
FIG. 4A is a schematic view showing the configuration of the electrically conductive fabric manufacturing apparatus according to the first embodiment of the present invention.
Figure 4B:
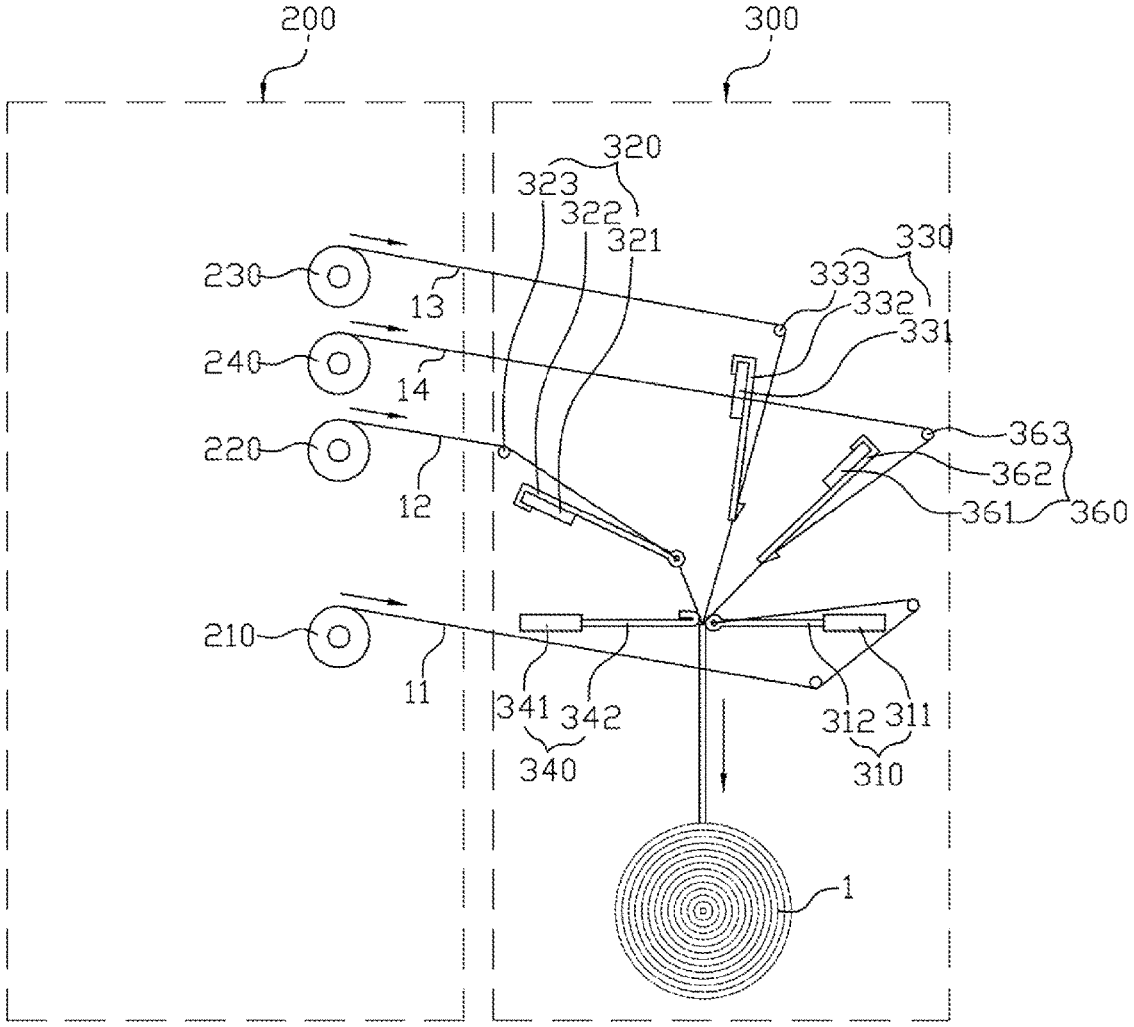
FIG. 4B is a schematic view showing the configuration of the electrically conductive fabric manufacturing apparatus according to the modification of the first embodiment of the present invention.
Figure 5A:
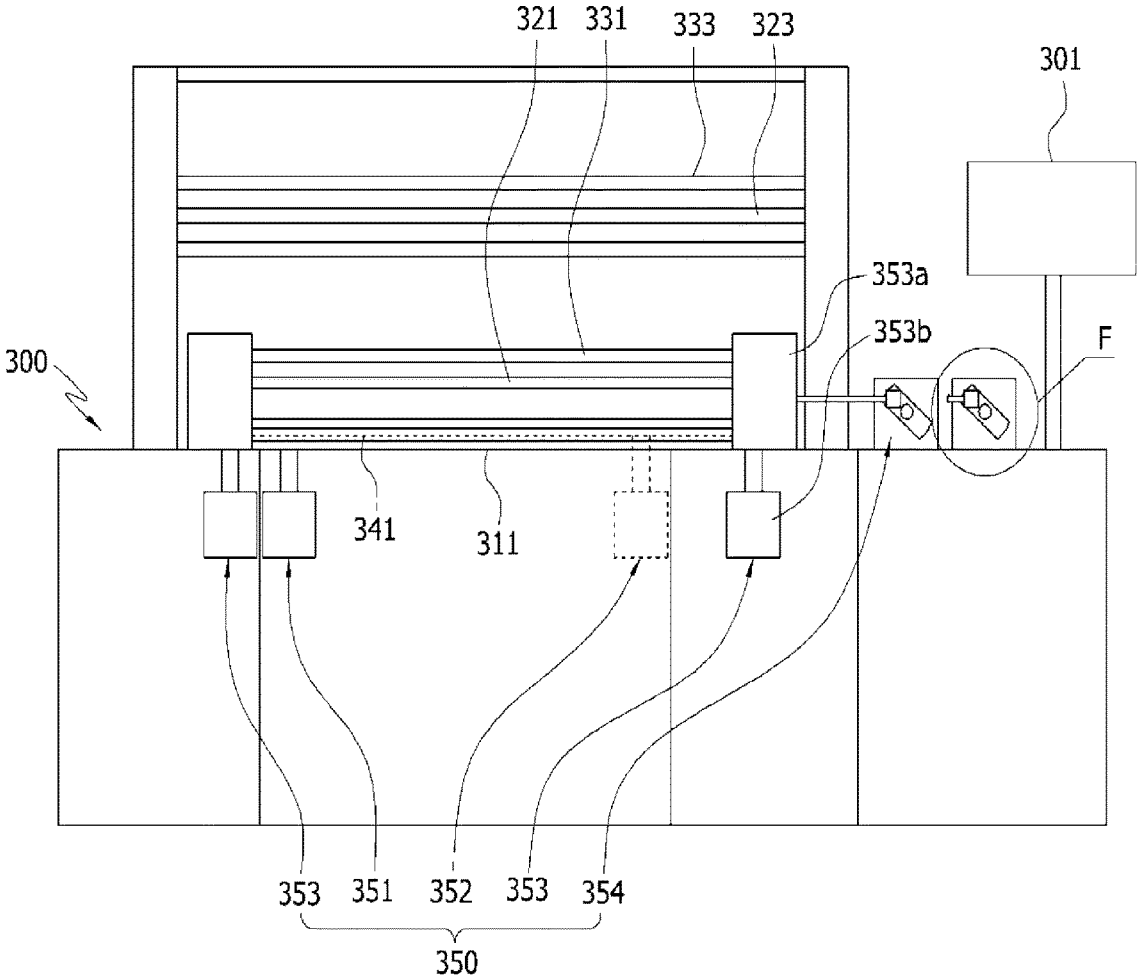
FIG. 5A is a front view schematically showing the overall structure of the electrically conductive fabric manufacturing apparatus according to the first embodiment of the present invention.
Figure 5B:
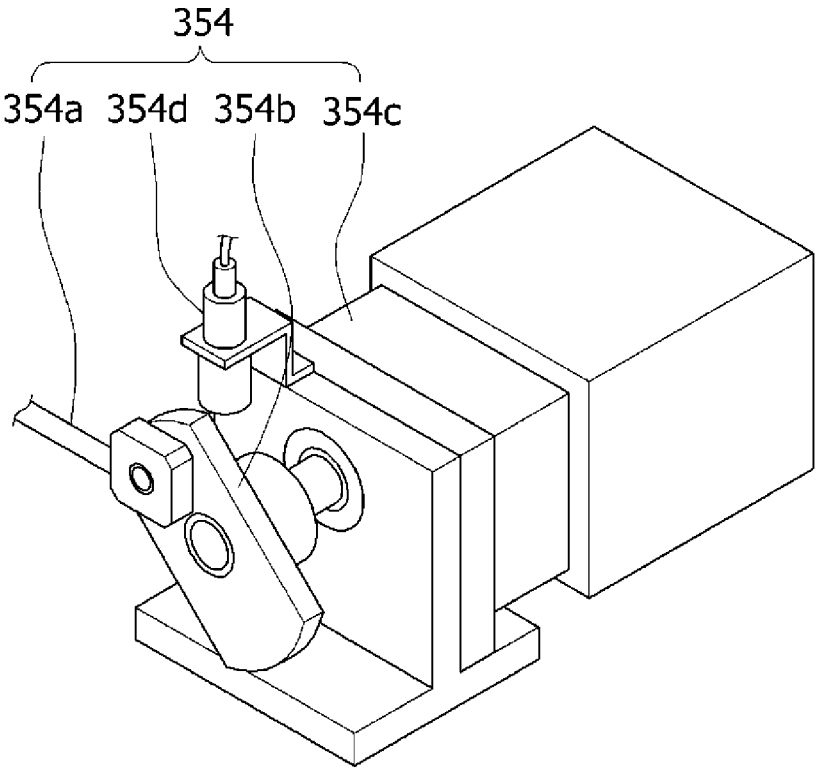
FIG. 5B is an enlarged perspective view of portion F of FIG. 5A.
Figure 6A:
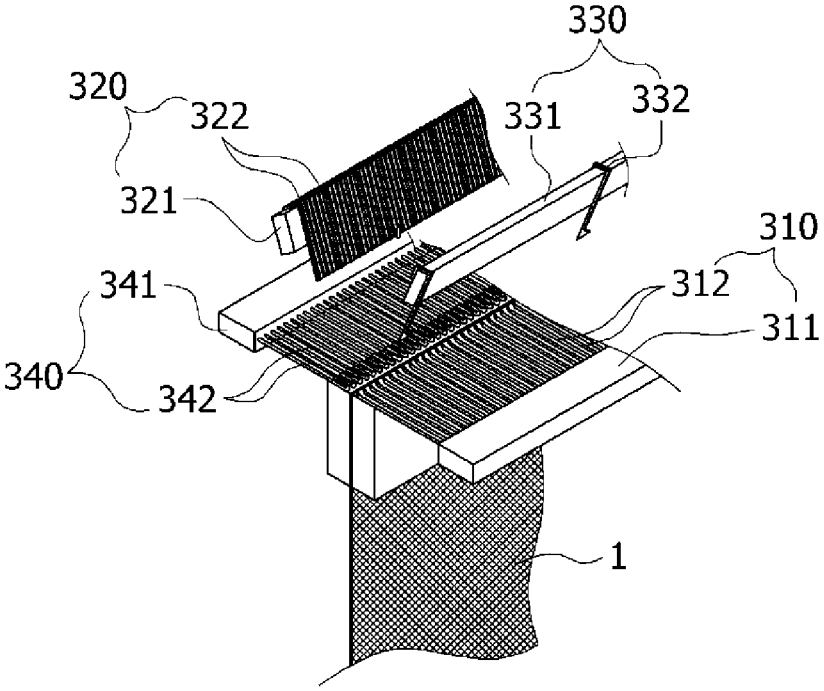
FIG. 6A is a perspective view of the major part of the electrically conductive fabric manufacturing apparatus according to the first embodiment of the present invention.
Figure 6B:
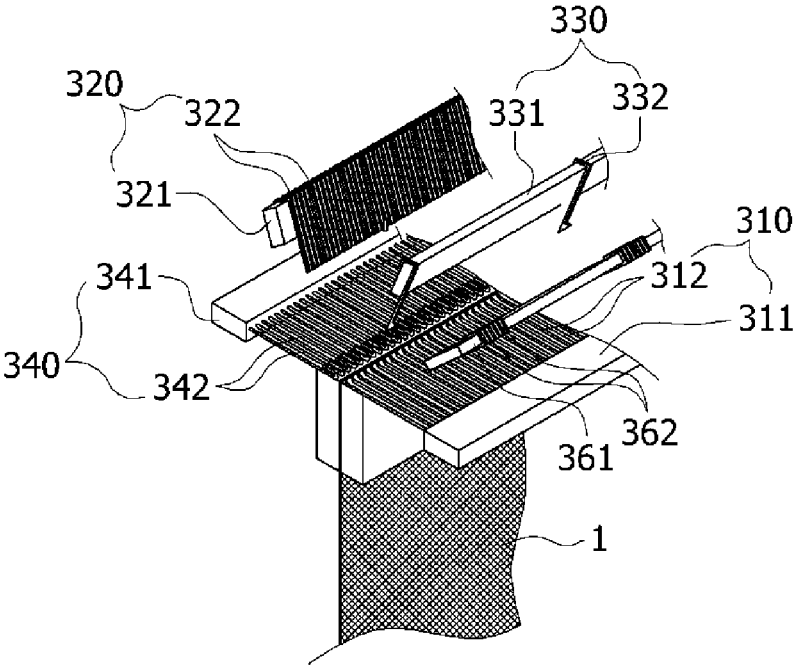
FIG. 6B is a perspective view of the major part of the electrically conductive fabric manufacturing apparatus according to the modification of the first embodiment of the present invention.

FIG. 4A is a schematic view showing the configuration of the electrically conductive fabric manufacturing apparatus according to the first embodiment of the present invention, FIG. 4B is a schematic view showing the configuration of the electrically conductive fabric manufacturing apparatus according to the modification of the first embodiment of the present invention, FIG. 5A is a front view schematically showing the overall structure of the electrically conductive fabric manufacturing apparatus according to the first embodiment of the present invention, FIG. 5B is an enlarged perspective view of portion F of FIG. 5A, FIG. 6A is a perspective view of the major part of the electrically conductive fabric manufacturing apparatus according to the first embodiment of the present invention, and FIG. 6B is a perspective view of the major part of the electrically conductive fabric manufacturing apparatus according to the modification of the first embodiment of the present invention. Specifically, FIGS. 6A and 6B are views showing a warp weaving unit 310, a web weaving unit 320, an electrically conductive wire weaving unit 330, and a warp guiding unit 340.

With reference to FIGS. 4A, 5A, 5B and 6A, the electrically conductive fabric manufacturing apparatus according to the first embodiment of the present invention includes a warp feeding unit 210, a weft feeding unit 220 and an electrically conductive wire feeding unit 230 for feeding the warp 11, the weft 12 and the electrically conductive wire 13, respectively; and the warp weaving unit 310, the weft weaving unit 320, the electrically conductive wire weaving unit 330, and the warp guiding unit 340 which are arranged on a frame 300 so as to carry out the weaving process; and a weaving unit driving device 350.

The warp feeding unit 210, the weft feeding unit 220 and the electrically conductive wire feeding unit 230 are reels on which the warp 11, the weft 12 and the electrically conductive wire 13 are wound, respectively, as shown in FIG. 4A. They are composed in quantities corresponding to the quantity of strands of the warp, weft and electrically conductive wire required for weaving the electrically conductive fabric, and are mounted on a reel mounting deck 200. At this time, the reels are spools for winding the warp, weft and electrically conductive wire, and they are of such a structure in which circular retaining plates are installed on both sides of the center winding rod.

The warp weaving unit 310 is of such a composition in which multiple strands of warp 11 fed from the warp feeding unit 210 are woven lengthwise, as shown in FIGS. 4A and 6A. There is a plurality of warp needles 312, on which the warp 11 thread are arranged, on the first support 311 installed laterally on the frame 300.

The electrically conductive wire weaving unit 330 is of a composition in which at least one strand of the electrically conductive wire 13 fed from the electrically conductive wire feeding unit 230 is woven. There is at least one or more electrically conductive wire needles 332, on which the electrically conductive wire threads on the second support 331 that is positioned above the warp weaving unit 310 and installed laterally are arranged, and above the second support 331 is laterally installed an electrically conductive wire guiding rod 333 to guide the movement of the electrically conductive wire 13.

The weft weaving unit 320 is for weaving the multiple strands of weft 12 fed from the weft feeding unit 220. In it are arranged a plurality of weft needles 322 threaded with the weft 12 on the third support 321 which is laterally installed in contact with the second support 331, and above this support 321 is laterally installed a weft guiding rod 323 to guide the movement of the weft.

The warp guiding unit 340 pulls the warp 11 on the side of the warp weaving unit 310 and operates so as to have the warp 11, the weft 12 and the electrically conductive wire 13 woven through interaction between the weft weaving unit 320 and the electrically conductive wire weaving unit 330. In it are installed in array a plurality of pull needles 342 which hook and pull the warp 11 threaded into the warp needle 312 on the fourth support 341 installed laterally in opposition to the first support 311. And the pull needle 342 is formed in such a structure in which a hook (nose) is formed at the end of the needle station, so that it can hook and tie the warp 11 on the side of the warp needle 312 when moving forward and can pull the warp when moving backward.

The weaving unit driving device 350 is of a composition for operating the warp weaving unit 310, the weft weaving unit 320, the electrically conductive wire weaving unit 330 and the warp guiding unit 340 so that the weft 12 can be woven in the direction perpendicular to the progressing warp 11 and the electrically conductive wire 13 can be woven selectively with the warp 11. Since it is composed in such a way that it is possible to selectively regulate the operating area of the warp weaving unit 310, the weft weaving unit 320 and the electrically conductive wire weaving unit 330, the electrically conductive wire 13 is woven, while repetitively forming the electrically conductive wire weaving section a in which the electrically conductive wire 13 is woven with the warp 11 and/or weft 12 to be bound monolithically to the electrically conductive fabric 1, and the electrically conductive wire exposing section b in which the electrically conductive wire 13 is not woven with the warp and/or weft but is exposed to the outside of the electrically conductive fabric 1 by a predetermined length.

And the weaving unit driving device 350 is composed, as shown in FIG. 5A, in such a way that it is connected so as to transmit driving force to the first to fourth supports 311, 331, 321 and 341 to have the first support 311 make translational motion upward and downward, have the second and the third supports 331 and 321 make translational motion laterally, upward and downward, and have the fourth support 341 make translational motion forward and backward. For this purpose, the weaving unit driving device 350 includes a first support driving unit 351, a fourth support driving unit 352, a support lifting-lowering unit 353 and a lateral driving unit 354.

The first support driving unit 351 is for moving the first support 311 up and down. It elevates the first support 311 to lift the warp needle 312 so that the pull needle 342 can hook and tie the warp 11 easily as it moves forward according to the advancing action of the fourth support 341 and moves the warp needle 312 downward as the first support 311 descends when the fourth support 341 moves backward. As long as the first support driving unit 351 is of a structure whereby the first support 311 can be moved up and down, it can be composed in such a way that it has various mechanisms without any particular limit. For example, the first support driving unit 351 can be composed in such a way that a cam (now shown) is installed on the axis rotated by a motor (not shown) so as to move the first support 311 up and down according to the rotating action of the cam, or can be composed of an electric cylinder (not shown) or pneumatic cylinder (not shown) to move the first support up and down according to the forward and backward motion of the rod. Besides, the first support driving unit 351 may as well be composed by a belt driving device (not shown) provided with a motor, pulleys, and a timing belt, etc.

The fourth support driving unit 352 is of a composition for moving the fourth support 341 forward and backward. As long as the fourth support 341 can be moved forward and backward so that the pull needle 342 can be moved forward and backward, it can be composed in such a way that it has widely known various mechanisms such as a motor with a cam, electric cylinder and pneumatic cylinder.

The support lifting-lowering units 353 are for moving the second and the third supports 331 and 321 up and down. They are installed on both sides of the frame 300 as shown in FIG. 5A and consist of a lifting-lowering block 353*a* into which the second and the third supports 331 and 321 are inserted, and a lifting-lowering device 353*b* for moving up and down the lifting-lowering block 353*a*. At this time, the lifting-lowering device 353*b* may be composed of an electric cylinder, pneumatic cylinder, motor with cam, belt driving device, etc.

The lateral driving unit 354 is for moving the second and the third supports 331 and 321 laterally as shown in FIGS. 5A and 5B. It includes a connecting rod 354*a* composed in a matching quantity so as to be connected with the one end portion of the second and the third supports 331 and 321 on one side of the frame 300, a cam member 354*b* connected to each connecting rod 354*a*, a motor 354*c* which provides driving force to the second and the third supports as the cam member 354*b* is connected to its output axis, and a sensor 354*d* that detects the pivot angle of the cam member 354*b* and sends the detected signal to the control unit (not shown) to control the drive of the motor 354*c*.

Meanwhile, the apparatus for manufacturing the electrically conductive fabric of the shape illustrated in FIG. 1F may further include a weaving unit 360 for binding and releasing to weave the binding-and-releasing weft 14 that weaves and ties the electrically conductive wire 13 to the warp 11 and/or weft 12, instead of the electrically conductive wire 13 which is not bound by the weft 12 as shown in FIGS. 4B and 6B.

The weaving unit 360 for binding and releasing is for weaving in such a way that the electrically conductive wire 13 is bound to the warp 11 and/or weft 12 in the electrically conductive wire weaving section a by using plural strands of weft fed from a weft feeding unit 240 installed on the reel mounting deck 200, and for weaving with the warp 11 and/or weft 12 in the electrically conductive wire exposing section b in such a way that the electrically conductive wire 13 is not to be bound to the electrically conductive fabric 1.

In addition, the weaving unit 360 for binding and releasing is installed in such a way that a plurality of binding and releasing needles 362, which the binding-and-releasing weft 14 threads on the fifth support 361 installed laterally at the opposing position of the third support 321 opposed to the second support 331, are positioned in the placement area of the electrically conductive wire 13.

Also, the weaving unit driving device 350 is composed in such a way that the fifth support 361 is moved laterally and in the up and down directions, but the lateral translational motion of the fifth support 361 is operated within the range where the binding-and-releasing weft 14 is woven to the electrically conductive wire 13 in the electrically conductive wire weaving section a, and the lateral translational motion of the fifth support 361 is operated within the range where the binding-and-releasing weft 14 is not woven with the electrically conductive wire 13 in the electrically conductive wire exposing section b.

For this purpose, the fifth support 361 is inserted and installed in the lifting-lowering block 353*a* of the support lifting-lowering unit 353 composed to move up and down the second and the third supports 331 and 321, and the weaving unit driving device further includes another lateral driving unit 354, which is composed of the connecting rod 354*a*, cam member 354*b*, motor 354*c* and sensor 354*d*, to move the fifth support laterally.

Meanwhile, the numeral 301 shown in FIG. 5A is an input unit for inputting the drive signals of the weaving unit driving device 350, and according to the signals inputted from the input unit 301, the control unit (not shown) can control the weaving unit driving device 350 to regulate the woven shape of warp and weft, the laterally moved distance of the electrically conductive wire, the width of the electrically conductive wire bent portion if the electrically conductive wire is woven in a waveform structure, the number of bent times, etc.

Figure 7:
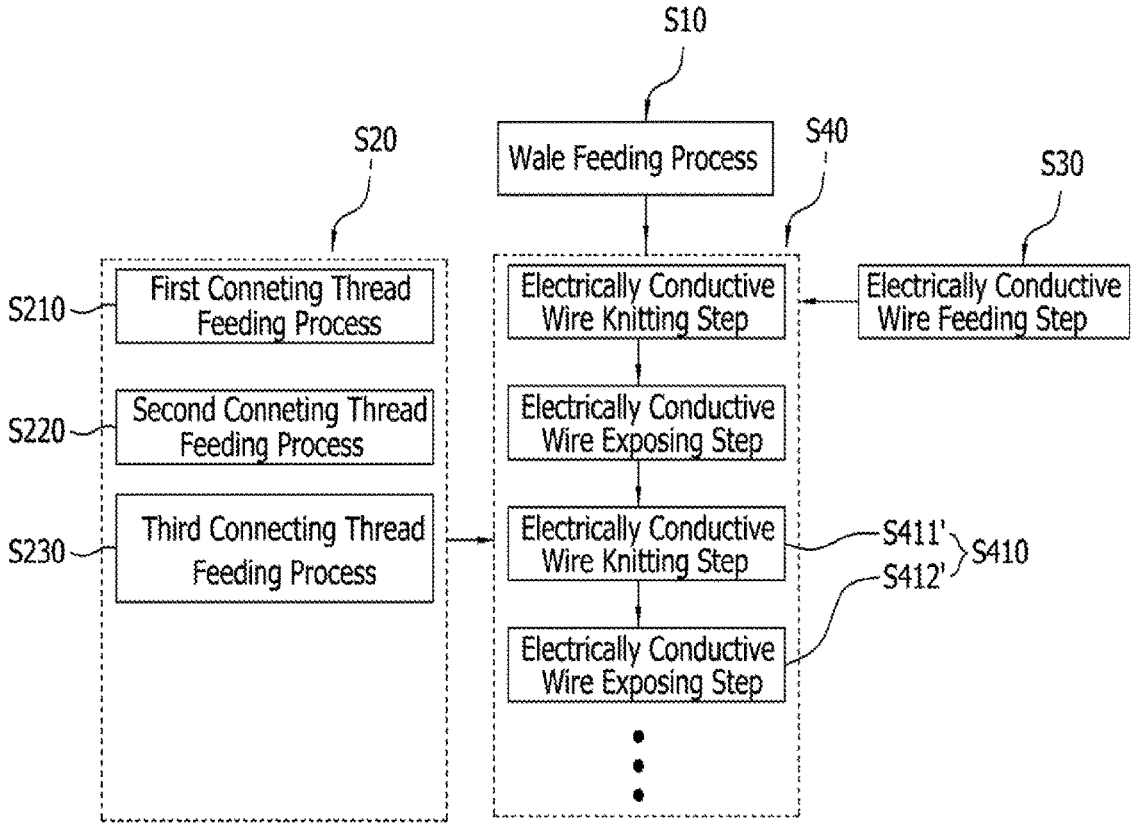
FIG. 7 is a block diagram for describing the manufacturing method of the electrically conductive fabric according to the second embodiment of the present invention.

FIG. 7 is a block diagram of the process for describing the manufacturing method of the electrically conductive fabric according to the second embodiment of the present invention.

With reference to FIG. 7, the manufacturing method of the electrically conductive fabric according to the second embodiment of the present invention relates to a method of manufacturing an electric conductive fabric of the shape illustrated in FIGS. 2A to 2D, and likewise as the manufacturing method of the electrically conductive fabric according to the first embodiment described above, it comprises wale threads feeding process (S10), connecting thread feeding process (S20), electrically conductive wire feeding process (S30) and a fabric knitting process (S40), which includes an electrically conductive wire knitting process (S410) for weaving electrically conductive wires as well.

The electrically conductive wire knitting process (S410) comprises an electrically conductive wire knitting step (S411') for knitting the electrically conductive wire 13 with the wale 21, and an electrically conductive wire exposing step (S412') in which the electrically conductive wire 13 is fed while the electrically conductive wire knitting step (S411') is under way but it is made not to be knitted with the wale 21 so that it is exposed to the outside of the electrically conductive fabric 1' by a predetermined length.

The connecting thread feeding process (S20) includes the first connecting thread feeding process (S210), the second connecting thread feeding process (S220) and the third connecting thread feeding process (S230).

The first connecting thread feeding process (S210) is for feeding the first connecting thread 22*a* that is connected with the wale 21 inside of the electrically conductive wire 13, and the connecting thread face arrayed on the inner surface of the electrically conductive fabric 1' after the electrically conductive wire knitting process (S410) carried out is formed in this process.

In the second connecting thread feeding process (S220, see FIGS. 2C and 2D), the second connecting thread 22*b* that is connected with the wale 21 outside of the electrically conductive wire 13 is fed, but in the range of width corresponding to the placement width of the electrically conductive wire 13, the feeding of second connecting thread 22*b* is excluded to provide a feeding free zone.

The third connecting thread feeding process (S230, see FIG. 2B) is to feed the third connecting thread 22*c* to be used for knitting and tying the electrically conductive wire 13 selectively to the wale 21 at a separated position corresponding to the feeding free zone formed in the second connecting thread feeding process (S22).

The electrically conductive wire knitting step (S411', see area a of FIG. 2A) simultaneously carries out the process of knitting and tying to the wale 21 the first and second connecting threads 22*a* and 22*b* and the third connecting 22*c* (see FIG. 2D), in such a way that the electrically conductive wire 13 is knitted and bound by the third connecting thread 22*c* to both of the wale 21 and the first connecting thread 22*a* (see FIG. 2B). And in the electrically conductive wire knitting step (S411') the electrically conductive wire 13 can be arranged also in a straight form structure along the direction of the wale 21, but in the present embodiment the electrically conductive wire 13 is arranged in a wave form structure.

And in the electrically conductive wire exposing step (S412', see area b of FIG. 2A) the first and second connecting threads 22*a* and 22*b* are knitted to the wale 21 (see FIG. 2D), and the third connecting thread 22*c* is connected to the wale 21, but in such a way that the electrically conductive wire is knitted within the range where it is not bound to the wales 21 and the first connecting thread 22*a* (see FIG. 2C). If work is carried out in such a way that the third connecting thread 22*c* is not knitted to the electrically conductive wire but knitted only to the wale 21 by minifying the laterally moving range of the fifth support 361 to be described later, the electrically conductive wire 13 is exposed to the outside of the electrically conductive fabric 1' to form an electrically conductive wire exposing section b.

Meanwhile, in the electrically conductive wire knitting step (S411'), it is preferable to knit by feeding the support wire 15 together with the electrically conductive wire 13 so as to be arranged on the left and right sides along the placement path, in order to prevent the protrusion or twisting of the electrically conductive wire 13 knitted in the electrically conductive fabric 1'. For this purpose, it is preferable to install a support wire needle 334' on the second support 331' that corresponds to the left and right sides of the electrically conductive wire needle 332' for knitting the electrically conductive wire 13 as will be described later (see FIG. 9) and thread the support wire needle 334' with the support wire 15 to feed it.

Such an electrically conductive fabric manufacturing method according to the second embodiment of the present invention can be carried out by an electrically conductive fabric manufacturing apparatus to be described in detail below.

Figure 8:
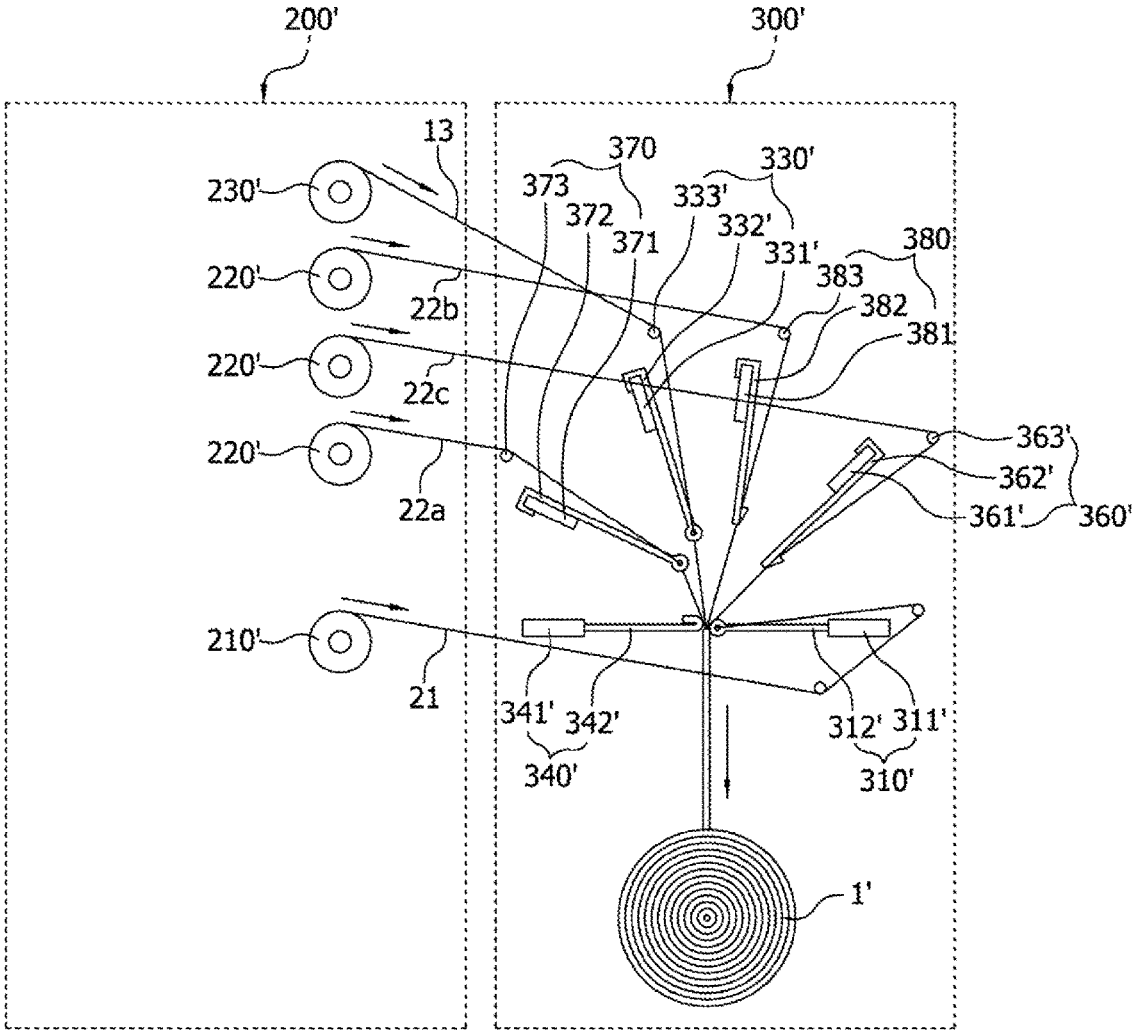
FIG. 8 is a schematic view showing the configuration of the electrically conductive fabric manufacturing apparatus according to the second embodiment of the present invention.
Figure 9:
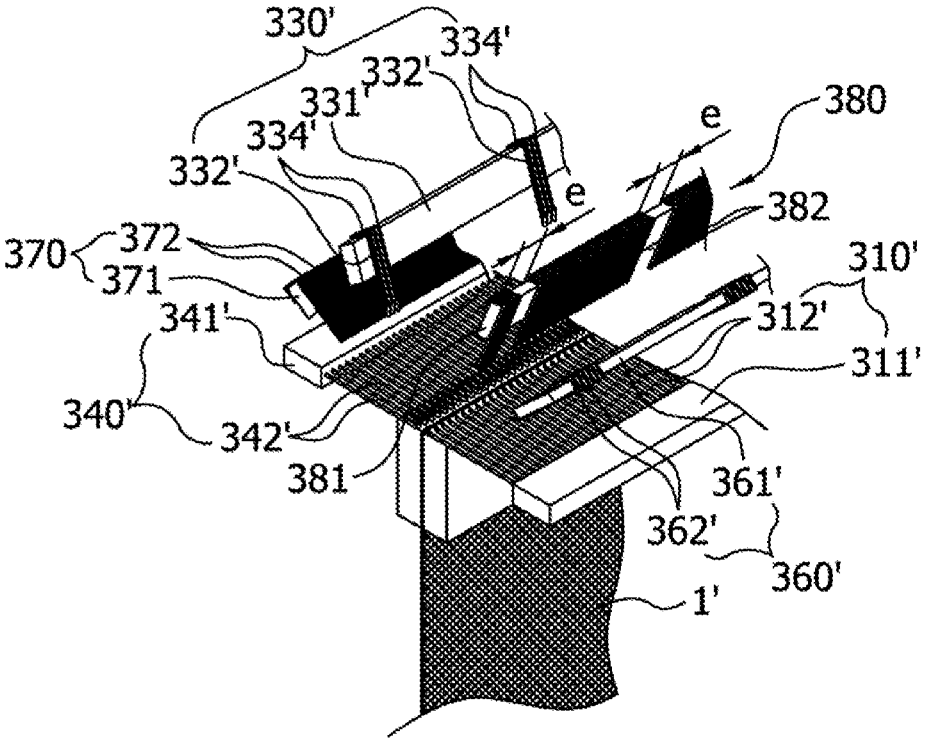
FIG. 9 is a perspective view of the major part of the electrically conductive fabric manufacturing apparatus according to the second embodiment of the present invention.

FIG. 8 is a schematic view showing the composition of an electrically conductive fabric manufacturing apparatus according to the second embodiment of the present invention, and FIG. 9 is a perspective view of the major part of the electrically conductive fabric manufacturing apparatus according to the second embodiment of the present invention. The overall appearance structure and a weaving unit driving device 350' of the electrically conductive fabric manufacturing apparatus according to the second embodiment is similar to the first embodiment, so detailed illustration is omitted. And a duplicated description is omitted for the composition similar to the electrically conductive fabric manufacturing apparatus according to the first embodiment.

With reference to FIGS. 5A, 5B, 8 and 9, the electrically conductive fabric manufacturing apparatus according to the second embodiment of the present invention includes a wale feeding unit 210' for feeding the wale threads 21, a connecting thread feeding unit 220' for feeding the first and second connecting threads 22*a* and 22*b*, and the third connecting thread 22*c*, and an electrically conductive wire feeding unit 230' for feeding the electrically conductive wire 13, a wale knitting unit 310', a first connecting thread knitting unit 370', a second connecting thread knitting unit 380', an electrically conductive wire knitting unit 330', a wale guiding unit 340' composed on the frame 300' to carry out the knitting process; and the knitting unit driving device 350'.

The wale feeding unit 210', the connecting thread feeding unit 220' and the electrically conductive wire feeding unit 230' are composed of reels on which the wale, connecting thread and electrically conductive wire are knitted, respectively, in the similar manner as the first embodiment, but since the connecting threads of the second embodiment are divided into the first and second connecting threads 22*a* and 22*b*, and the third connecting thread 22*c*, each reel is installed separately.

The wale knitting unit 310' is of a composition for knitting lengthwise the multiple strands of the wale fed from the wale feeding unit 210', and in it are installed a plurality of wale needles 322 which the wale threads on the first support 321 installed laterally on the frame 300'.

The electrically conductive fabric knitting unit 330' is of a composition in which at least one strand of electrically conductive wire 13 is fed from the electrically conductive wire feeding unit 230' positioned above the wale knitting unit 310', and in it are installed at least one electrically conductive wire needle 332' on which the electrically conductive wire 13 threads in the second support 331' installed laterally.

And it is preferable to install in the second support 331' a support wire needle 334' on which the support wire 15 is thread on the left and right of the electrically conductive wire needle 332', so that it is possible to knit the support wire 15 so as to be arranged on the left and right of the placement path of the electrically conductive wire 13, as shown in FIG. 9. At this time, the support wire needle 334' is installed at a given clearance from the electrically conductive wire 332' so as to match the clearance of the support wire 15.

The wale guiding unit 340' is positioned in opposition so that it can pull the wale 11; on the side of the wale knitting unit 310'. It is operated in such a way that the first and second connecting threads 22*a* and 22*b* and the electrically conductive wire 13 are knitted through interaction between the first and second connecting thread knitting units 370' and 380' and the wale knitting unit 310'. In it are installed a plurality of pull needles 342' for hooking and pulling the wale 21 threaded into the wale needle 322 on the fourth support 341' installed laterally.

The first connecting thread knitting unit 370' is positioned on one side of the electrically conductive wire knitting unit 330' to knit on the wale 21 the multiple strands of the first connecting thread 22*a* for knitting wale thread fed from the connecting thread feeding unit 220' so as to form one side face of the electrically conductive fabric 1'. In it are arranged a plurality of connecting thread needles 372 into which are fed the first connecting thread 22*a* on a third-a support 371 installed laterally in contact with the inner side of the second support 331', and above the third-a support 371 is installed laterally a connecting thread guiding bar 373 so as to guide the movement of the first connecting thread.

The second connecting thread knitting unit 380 is positioned on the other side of the electrically conductive wire knitting unit 330' to knit with the wale 21 the multiple strands of the second connecting thread 22*b* fed from the connecting thread feeding unit 220' so as to form the other side face of the electrically conductive fabric 1'. On a third-b support 381 installed laterally in contact with the outside of the second support 331' facing the third-a support 371 are arranged a plurality of connecting thread needles 382 threaded by the second connecting thread 22, and above the third-b support 371 is installed laterally a connecting thread guiding bar 383 to guide the movement of the second connecting thread 22*b*.

The knitting unit driving device 350' operates the wale knitting unit 310', the first and second connecting thread weaving units 370 and 380, the electrically conductive wire knitting unit 330' and the wale guiding unit 340' so that the first and second connecting threads 22*a* and 22*b* are knitted perpendicular to the wale 21 and the electrically conductive wire 13 is knitted selectively in the direction of the wale.

In particular, the knitting unit driving device 350' can selectively regulate the operation areas of the first and second connecting thread knitting units 370 and 380, the electrically conductive wire knitting unit 330', etc., so it is characterized by being able to knit an electrically conductive fabric having the electrically conductive wire knitting section a in which the electrically conductive wire 13 is knitted with the wale 21 and/or the first and second connecting threads 22*a* and 22*b* so as to be bound monolithically to the electrically conductive fabric 1', and the electrically conductive wire exposing section b in which the electrically conductive wire is not knitted to the wale and/or the first and second connecting threads but is exposed to the outside of the electrically conductive fabric.

For this purpose, the knitting unit driving device 350' includes a first support driving unit 351', which is instrumentally connected so as to transmit driving force to the first to fourth supports in order to have the first support 321 make translational motion upward and downward, and the second, third-a and third-b supports 331', 371 and 381 make translational motion laterally and upward and downward, and the fourth support 341 make translational motion forward and backward, and a fourth support driving unit 352', a support lifting-lowering unit 353' and a lateral driving unit 354'. Although detailed description is omitted because it is similar to the aforementioned first embodiment, the lateral driving unit 354' further includes a connecting rod 354'*a* for driving the third-b support 381, cam member 354'*b*, motor 354'*c* and sensor 354'*d*.

Meanwhile, the electrically conductive fabric manufacturing apparatus according to the second embodiment is characterized in that the second connecting thread weaving unit 380 has a needle free section e in which the connecting thread needle 382 is not positioned in the range of width corresponding to the placement width of the electrically conductive wire needle 332', and that it includes a knitting unit 360' for binding and releasing which selectively knits the third connecting thread 22*c* to the area corresponding the needle free section e.

In the knitting unit 360' for binding and releasing, a needle 363' for knitting electrically conductive yarn in the area corresponding to the needle free section e is arranged in the fifth support 361' which is positioned in contact with the second connecting thread knitting unit 380 and is moved laterally and upward and downward by the knitting unit driving device 350'.

The fifth support 361' carries out the knitting process while moving the electrically conductive yarn-knitting needle 362' according to the action of the knitting unit driving device 350' so as to form the electrically conductive wire knitting section a and the electrically conductive wire exposing section b. In other words, as shown in FIGS. 2B and 9, in the electrically conductive wire weaving (knitting) section a, it operates the moved distance (the lateral translational motion range of the fifth support) of the electrically conductive yarn-knitting needle 362' by limiting to the range in which the third connecting thread 12*c* is knitted with the electrically conductive wire 13, and as shown in FIGS. 2C and 9, in the electrically conductive wire exposing section b, it operates the moved distance (the lateral translational motion range of the fifth support) of the electrically conductive yarn-knitting needle 362' by limiting to the range in which the third connecting thread 12*c* is not knitted with the electrically conductive wire 13.

Meanwhile, the process for knitting electrically conductive fabric will be described briefly by using the electrically conductive fabric manufacturing apparatus according to the present second embodiment.

First, the input unit 301' is set such that in the electrically conductive wire knitting section a, the electrically conductive wire 13 is knitted in a waveform structure and the electrically conductive wire exposing section b is formed at a predetermined interval and operates the knitting unit driving device 350', then the wale 21 is moved up and down by the action of the first support driving unit 351' to be fed toward the pull needle 342'. Accordingly, the pull needle 342' positioned in the fourth support 341' that is moved forward and backward according to the action of the fourth support driving unit 352' pulls the wale 21 to form a loop, and the knitting process is carried out as the second, third-a, third-b and fifth supports 331', 371, 381 and 361' make translational motion upward and downward and laterally by the action of the support lifting-lowering unit 353' and lateral driving unit 354'.

To describe this in more detail, as the fourth support 341' advances at the time of rising action of the first support 321, the pull needle 342' advances, and simultaneously as the second, third-a, third-b and fifth supports 331', 371, 381 and 361' are elevated, it moves toward the lateral side (in the direction of lateral driving unit side). Subsequently as the descending action of the first support 321 and the backing action of the fourth support 341' are carried out simultaneously, the pull needle 342' pulls the wale 21 to form a loop, and at this time, the second, third-a, third-b and fifth supports 331', 371, 381 and 361' descend gradually, continuing one lateral (toward the lateral driving unit) movement by the moved distance set respectively, and the first and second connecting threads, electrically conductive wire and the third connecting thread 22*a*, 22*b*, 22*c*, and 13 are knitted with the wale 21.

Subsequently, as the first support 321 rises and the fourth support 341' advances the pull needle 342' advances, and the second, third-a, third-b and fifth supports 331', 371, 381 and 361' move toward the other lateral side (the opposite direction of the lateral driving unit) together with a rising action. Continuously the descending action of the first support 321 is carried out and as the backing action of the fourth support 341' is carried out the pull needle 342' pulls the wale 21 to form a loop. At this time, the second, third-a, third-b and fifth supports 331', 371, 381 and 361' continue to move toward the other lateral side (the lateral driving unit) as much as the moved distance set respectively, and the first and second connecting threads 22*a* and 22*b*, the electrically conductive wire 13 and the third connecting thread 22*c* are knitted with the wale 21 one more time.

Thus, if the up and down actions of the first support 321 and the forward and backward moving actions of the fourth support 341' are carried out simultaneously with the up and down of the second, third-a, third-b and fifth supports 331', 371, 381 and 361' and the actions of moving toward one side and the other side are carried repetitively, an electrically conductive fabric 1' of a shape (see FIG. 2B) in which the first and second connecting threads 22*a* and 22*b* are arranged on both sides of the wale 21 and the electrically conductive wire 13 is arranged at the position corresponding to the inside of the third connecting thread 22*c* is knitted and discharged downward.

At this time, in the electrically conductive wire knitting section a, the electrically conductive wire knitting section a of the electrically conductive fabric 1' as shown in FIG. 2B is formed under the control of the control unit (not shown) by increasing the rotation range of the motor 354'*c* of the lateral driving unit 354' connected with the fifth support 361' and operating by limiting the moved distance (the range of the lateral translational motion of the fifth support 351') of the electrically conductive yarn-knitting needle 362' to the range in which the third connecting thread 22*c* is knitted with the electrically conductive wire 13. Conversely, in the electrically conductive wire exposing section b, the electrically conductive wire exposing section b of the electrically conductive fabric 1' as shown in FIG. 2C is formed under the control of the control unit by decreasing the rotation range of the motor 354'*c* and operating by limiting the moved distance (the range of the lateral translational motion of the fifth support) of the electrically conductive yarn-knitting needle 362' to the range in which the third connecting thread 22*c* is not knitted with the electrically conductive wire 13.

The invention claimed is:

1. An electrically conductive fabric comprising:

multiple strands of wales arranged lengthwise;

multiple strands of connecting threads connected with the wales; and at least one strand of electrically conductive wire arranged lengthwise, wherein the electrically conductive fabric includes a repeated pattern of:

a knitted section in which the electrically conductive wire is bound by at least two of the strands of connecting threads; and an electrically conductive wire exposing section in which the electrically conductive wire is not bound by at least one of the strands of connecting threads but is exposed to the outside of the electrically conductive fabric by a predetermined length, and wherein the strands of connecting threads include:

a first connecting thread which is connected with the strands of wales in a manner that the first connecting thread is disposed at one side of the electrically conductive wire;

a second connecting thread which is connected with the strands of wales in an area where the electrically conductive wire is not arranged; and a third connecting thread which is connected with the strands of wales to selectively bind the electrically conductive wire, wherein the electrically conductive wire is bound by the third connecting thread and the first connecting thread in the knitted section such that the third connecting thread is disposed at another side of the electrically conductive wire which is opposite to the one side of the electrically conductive wire, and the electrically conductive wire is not bound by the third connecting thread in the electrically conductive wire exposing section.

2. The electrically conductive fabric of claim 1, wherein the strands of wales are stretchable fiber yarns so that the electrically conductive fabric has stretchability lengthwise.

3. The electrically conductive fabric of claim 1, further comprising support yarns which are arranged on left and right sides of the electrically conductive wire to prevent twisting of the electrically conductive wire.

4. The electrically conductive fabric of claim 1, wherein the electrically conductive wire is arranged in a straight form or a wave form along a direction of the strands of wales.

5. The electrically conductive fabric of claim 1, wherein the electrically conductive wire is a bundle type wire including strands of insulated electrically conductive yarn, and strands of fiber yarn wound on an outer circumference of the electrically conductive yarn to act as a sheath.

6. The electrically conductive fabric of claim 1, wherein the electrically conductive wire is a stretchable wire including a stretchable inner wire disposed in an inner center, plural strands of electrically insulated wire wound on the inner wire, and outer fiber yarn wound on an outer circumference of the electrically conductive yarn.

* * * * *